US011255136B2

(12) United States Patent
Spatz et al.

(10) Patent No.: US 11,255,136 B2
(45) Date of Patent: Feb. 22, 2022

(54) BOTTOM HOLE ASSEMBLIES FOR DIRECTIONAL DRILLING

(71) Applicant: XR LATERAL LLC, Houston, TX (US)

(72) Inventors: Edward Spatz, Houston, TX (US); Michael Reese, Houston, TX (US); David Miess, Houston, TX (US); Gregory Prevost, Houston, TX (US)

(73) Assignee: XR Lateral LLC, Houston, TX (US)

( * ) Notice: Subject to any disclaimer, the term of this patent is extended or adjusted under 35 U.S.C. 154(b) by 656 days.

(21) Appl. No.: 15/808,798

(22) Filed: Nov. 9, 2017

(65) Prior Publication Data

US 2018/0179831 A1 Jun. 28, 2018

Related U.S. Application Data

(63) Continuation-in-part of application No. 15/667,704, filed on Aug. 3, 2017, now Pat. No. 10,890,030.

(60) Provisional application No. 62/439,843, filed on Dec. 28, 2016.

(51) Int. Cl.
*E21B 17/10* (2006.01)
*E21B 7/06* (2006.01)

(52) U.S. Cl.
CPC ..... *E21B 17/1078* (2013.01); *E21B 7/067* (2013.01)

(58) Field of Classification Search
CPC ..... E21B 7/068; E21B 7/062; E21B 17/10; E21B 7/10; E21B 17/1014; E21B 17/1078; E21B 7/067
See application file for complete search history.

(56) References Cited

U.S. PATENT DOCUMENTS

| | | | | |
|---|---|---|---|---|
| 356,154 | A | 1/1887 | William et al. | |
| 1,638,337 | A | 8/1927 | Hutton et al. | |
| 1,667,155 | A | 4/1928 | Higdon et al. | |
| 2,919,897 | A | 1/1960 | Sims et al. | |
| 3,061,025 | A | 10/1962 | Stockard et al. | |
| 3,156,310 | A * | 11/1964 | Frisby | E21B 7/062 175/76 |
| 3,159,224 | A | 12/1964 | Cleary et al. | |
| 3,224,513 | A | 12/1965 | Weeden, Jr. et al. | |
| 3,561,549 | A * | 2/1971 | Garrison | E21B 17/10 175/76 |

(Continued)

FOREIGN PATENT DOCUMENTS

| | | |
|---|---|---|
| CA | 2291922 A1 | 6/2000 |
| EP | 530045 B1 | 4/1997 |

OTHER PUBLICATIONS

Kim et al. ("A Novel Steering Sections of Hybrid Rotary Steerable System for Directional Drilling", ICCAS 2014, pp. 1617-1619) (Year: 2014).

(Continued)

*Primary Examiner* — Kipp C Wallace
(74) *Attorney, Agent, or Firm* — Michael S. McCoy; Amatong McCoy LLC

(57) ABSTRACT

Directional drilling is an extremely important area of technology for the extraction of oil and gas from earthen formations. The technology of the present application relates to improved positioning elements for directional drilling assemblies. It also relates to drilling directional wellbores using the guidance positioning members of the present technology.

11 Claims, 11 Drawing Sheets

(56) References Cited

U.S. PATENT DOCUMENTS 3,880,246 A 4/1975 Farris
3,882,946 A 5/1975 Ioannesian
4,270,619 A 6/1981 Base et al.
4,373,592 A 2/1983 Dellinger et al.
4,385,669 A 5/1983 Knutsen et al.
4,407,377 A 10/1983 Russell
4,456,080 A 6/1984 Holbert et al.
4,465,147 A * 8/1984 Feenstra ..... E21B 7/068 175/73
4,485,879 A 12/1984 Kamp et al.
4,491,187 A 1/1985 Russell
4,492,276 A 1/1985 Kamp et al.
4,523,652 A 6/1985 Schuh et al.
4,577,701 A 3/1986 Dellinger et al.
4,618,010 A 10/1986 Falgout et al.
4,623,026 A * 11/1986 Kemp ..... E21B 7/10 175/325.3
4,667,751 A 5/1987 Geczy et al.
4,690,229 A 9/1987 Raney et al.
4,697,651 A 10/1987 Dellinger
4,715,453 A 12/1987 Falgout, Sr. et al.
4,729,438 A 3/1988 Walker et al.
4,739,843 A * 4/1988 Burton ..... E21B 17/10 175/325.4
4,775,017 A 10/1988 Forrest et al.
4,807,708 A * 2/1989 Forrest ..... E21B 7/068 175/325.2
4,842,083 A 6/1989 Raney et al.
4,848,490 A 7/1989 Anderson et al.
4,862,974 A 9/1989 Warren et al.
4,877,092 A 10/1989 Helm et al.
5,010,789 A 4/1991 Brett et al.
5,042,596 A 8/1991 Brett et al.
5,050,692 A * 9/1991 Beimgraben ..... E21B 7/067 175/256
5,099,929 A 3/1992 Keith et al.
5,099,931 A * 3/1992 Krueger ..... E21B 7/068 175/75
5,115,872 A 5/1992 Brunet et al.
5,131,479 A * 7/1992 Boulet ..... E21B 7/067 175/73
5,139,094 A 8/1992 Prevedel et al.
5,159,577 A 10/1992 Twist et al.
5,181,576 A 1/1993 Askew et al.
5,318,137 A * 6/1994 Johnson ..... E21B 17/1014 175/325.2
5,320,179 A 6/1994 Roos et al.
5,333,699 A 8/1994 Thigpen et al.
5,343,967 A * 9/1994 Kruger ..... E21B 7/068 175/107
5,361,859 A 11/1994 Tibbitts et al.
5,458,208 A 10/1995 Clarke
5,673,763 A 10/1997 Thorp
5,812,068 A * 9/1998 Wisler ..... E21B 47/022 340/855.5
5,857,531 A 1/1999 Estep et al.
5,904,213 A 5/1999 Caraway et al.
5,931,239 A 8/1999 Schuh
5,937,958 A 8/1999 Mensa-Wilmot et al.
5,957,223 A 9/1999 Doster et al.
5,967,246 A 10/1999 Caraway et al.
5,971,085 A 10/1999 Colebrook et al.
5,979,570 A 11/1999 McLoughlin et al.
5,992,547 A 11/1999 Caraway et al.
6,073,707 A 6/2000 Noe et al.
6,092,613 A 7/2000 Caraway et al.
6,109,372 A 8/2000 Dorel et al.
6,116,356 A * 9/2000 Doster ..... E21B 7/04 175/385
6,158,533 A 12/2000 Gillis et al.
6,186,251 B1 2/2001 Butcher et al.
6,213,226 B1 * 4/2001 Eppink ..... E21B 7/064 175/61
6,257,356 B1 7/2001 Wassell et al.
6,325,162 B1 * 12/2001 Eppink ..... E21B 7/064 175/57
6,349,780 B1 2/2002 Beuershausen et al.
6,427,792 B1 8/2002 Roberts et al.
6,523,623 B1 2/2003 Schuh et al.
6,722,453 B1 4/2004 Crooks et al.
6,742,605 B2 6/2004 Martini et al.
6,991,046 B2 1/2006 Fielder et al.
7,207,398 B2 4/2007 Runia et al.
7,562,725 B1 7/2009 Broussard et al.
7,831,419 B2 11/2010 Cariveau et al.
8,061,453 B2 11/2011 Cariveau et al.
8,162,081 B2 4/2012 Ballard et al.
8,176,999 B2 * 5/2012 Stroud ..... E21B 7/06 175/76
8,201,642 B2 6/2012 Radford et al.
8,210,283 B1 7/2012 Benson et al.
8,240,399 B2 8/2012 Kulkarni et al.
8,316,968 B2 11/2012 Ferrari et al.
8,448,721 B2 5/2013 Johnson et al.
8,448,722 B2 5/2013 Konschuh et al.
8,550,190 B2 10/2013 Hall et al.
8,757,298 B2 6/2014 Broussard et al.
8,763,726 B2 7/2014 Johnson et al.
D710,174 S 8/2014 Moss
D710,175 S 8/2014 Moss et al.
D710,176 S 8/2014 Santamarina
D713,706 S 9/2014 Jing et al.
D717,626 S 11/2014 Dickrede
8,905,159 B2 12/2014 Downton
9,016,400 B2 4/2015 Clausen et al.
D731,277 S 6/2015 Manwaring et al.
D732,364 S 6/2015 Rinaldis et al.
9,163,460 B2 10/2015 Meier et al.
9,556,683 B2 1/2017 Simmons et al.
9,605,482 B2 3/2017 Lange et al.
D786,645 S 5/2017 Svendsen et al.
D793,831 S 8/2017 Russell et al.
D793,832 S 8/2017 Russell et al.
D793,833 S 8/2017 Russell et al.
D813,003 S 3/2018 Chang
9,963,938 B2 5/2018 Foote et al.
2002/0056574 A1 * 5/2002 Harvey ..... E21B 17/1014 175/320
2002/0070021 A1 6/2002 Van et al.
2002/0112892 A1 * 8/2002 Taylor ..... E21B 7/062 175/61
2002/0175006 A1 11/2002 Findley et al.
2003/0010534 A1 1/2003 Chen et al.
2003/0024742 A1 2/2003 Swietlik et al.
2004/0216921 A1 * 11/2004 Krueger ..... E21B 7/068 175/24
2005/0096847 A1 5/2005 Huang
2005/0150692 A1 * 7/2005 Ballantyne ..... E21B 7/062 175/61
2005/0236187 A1 10/2005 Chen et al.
2006/0196697 A1 9/2006 Raney et al.
2007/0007000 A1 1/2007 Dewey et al.
2007/0163810 A1 7/2007 Underwood et al.
2007/0205024 A1 9/2007 Mensa-Wilmot et al.
2007/0235227 A1 10/2007 Kirkhope et al.
2007/0272445 A1 11/2007 Cariveau et al.
2008/0000693 A1 1/2008 Hutton et al.
2008/0047754 A1 2/2008 Evans et al.
2008/0053707 A1 3/2008 Martinez et al.
2008/0075618 A1 3/2008 Martin et al.
2008/0115974 A1 5/2008 Johnson et al.
2008/0190665 A1 8/2008 Earles et al.
2008/0271923 A1 11/2008 Kusko et al.
2009/0000823 A1 1/2009 Pirovolou
2009/0044980 A1 2/2009 Sheppard et al.
2009/0044981 A1 2/2009 Sheppard et al.
2009/0065262 A1 3/2009 Downton et al.
2009/0107722 A1 4/2009 Chen et al.
2009/0188720 A1 7/2009 Johnson et al.
2010/0006341 A1 1/2010 Downton
2010/0307837 A1 12/2010 King et al.
2011/0031025 A1 2/2011 Kulkarni et al.
2011/0247816 A1 10/2011 Carter

(56) References Cited

U.S. PATENT DOCUMENTS

| | | | | |
|---|---|---|---|---|
| 2012/0055713 | A1 | 3/2012 | Herberg et al. | |
| 2012/0234610 | A1 | 9/2012 | Azar et al. | |
| 2013/0043076 | A1* | 2/2013 | Larronde | E21B 7/062 175/61 |
| 2013/0180782 | A1 | 7/2013 | Ersan et al. | |
| 2014/0097026 | A1 | 4/2014 | Clark et al. | |
| 2014/0110178 | A1 | 4/2014 | Savage et al. | |
| 2014/0246209 | A1 | 9/2014 | Themig et al. | |
| 2014/0246234 | A1 | 9/2014 | Gillis et al. | |
| 2014/0311801 | A1 | 10/2014 | Jain et al. | |
| 2014/0379133 | A1 | 12/2014 | Toma | |
| 2015/0101864 | A1 | 4/2015 | May | |
| 2015/0122551 | A1 | 5/2015 | Chen | |
| 2015/0152723 | A1 | 6/2015 | Hay | |
| 2015/0322781 | A1 | 11/2015 | Pelletier et al. | |
| 2016/0024846 | A1 | 1/2016 | Parkin | |
| 2016/0024848 | A1 | 1/2016 | Desmette et al. | |
| 2016/0115779 | A1 | 4/2016 | Moss et al. | |
| 2016/0230465 | A1* | 8/2016 | Holtz | E21B 7/068 |
| 2016/0265287 | A1 | 9/2016 | Newman et al. | |
| 2016/0326863 | A1 | 11/2016 | Lange et al. | |
| 2017/0044833 | A1* | 2/2017 | Foote | E21B 7/068 |
| 2017/0130533 | A1 | 5/2017 | Ling | |
| 2017/0234071 | A1 | 8/2017 | Spatz et al. | |
| 2017/0241207 | A1* | 8/2017 | Meier | E21B 7/28 |
| 2017/0342778 | A1 | 11/2017 | Chen | |
| 2018/0073301 | A1 | 3/2018 | Russell et al. | |
| 2019/0055810 | A1 | 2/2019 | Fripp et al. | |

OTHER PUBLICATIONS

Matheus et al. ("Hybrid Approach to Closed-loop Directional Drilling Control using Rotary Steerable Systems", IFAC Workshop, 2012, pp. 84-89) (Year: 2012).

Warren et al. ("Casing Directional Drilling", AADE 2005 National Technical Conference and Exhibition, 2005, pp. 1-10) (Year: 2005).

International Search Report and the Written Opinion in PCT Application No. PCT/US2017/017515, dated Apr. 28, 2017, 8 pages.

International Search Report and Written Opinion in PCT Application No. PCT/US18/41316, dated Sep. 25, 2018, 14 pages.

International Searching Authority, International Search Report and Written Opinion, PCT Patent Application PCT/US2017/066707, dated Apr. 6, 2018, 13 pages.

International Searching Authority, International Search Report and Written Opinion, PCT Patent Application PCT/US2017/066745, dated Feb. 15, 2018, 9 pages.

Felczak, et al., "The Best of Both Worlds—A Hybrid Rotary Steerable System", Oilfield Review; vol. 23, No. 4, Winter 2011, pp. 36-44.

Warren, et al., "Casing Directional Drilling", AADE-05-NTCE-48; American Association of Drilling Engineers (AADE) 2005 National Technical Conference and Exhibition, Houston, Texas, Apr. 5-7, 2005, pp. 1-10.

APS Technology, "Rotary Steerable Motor for Directional Drilling." downloaded Nov. 13, 2017 from http://www.aps-tech.com/products/drilling-systems/rotary-steerable-motor, 4 pages.

PetroWiki, "Direction deviation tools," downloaded Nov. 13, 2017 from http://petrowiki.org/Directional_deviation_tools, 5 pages.

* cited by examiner

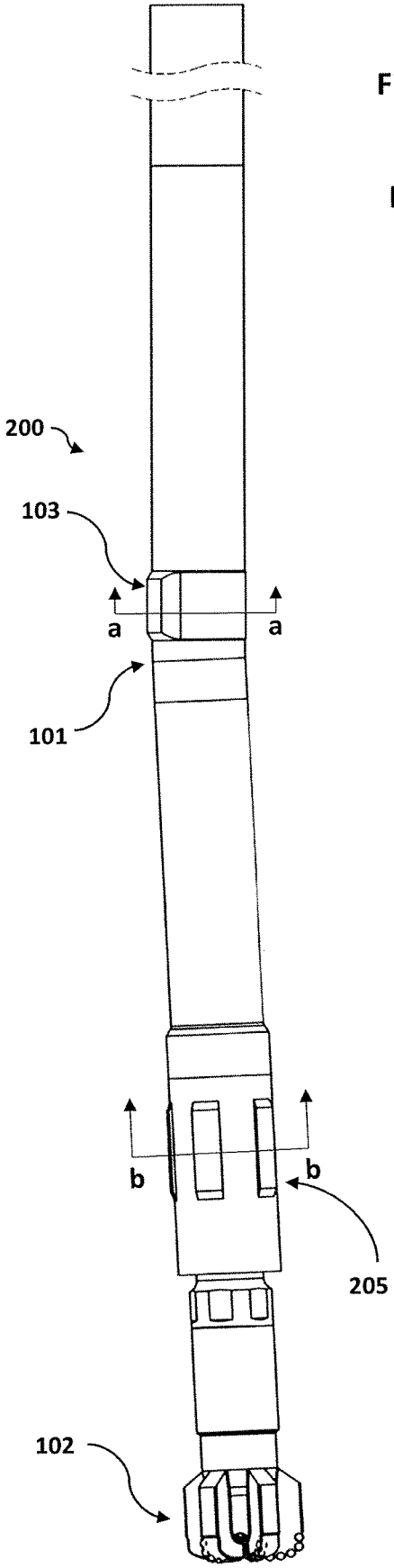
Figure 2
Prior Art
Figure 2a
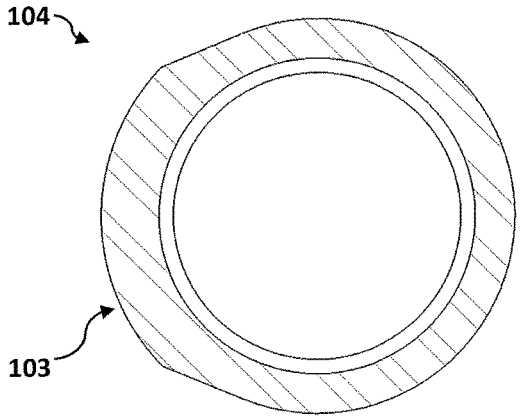
Figure 2b
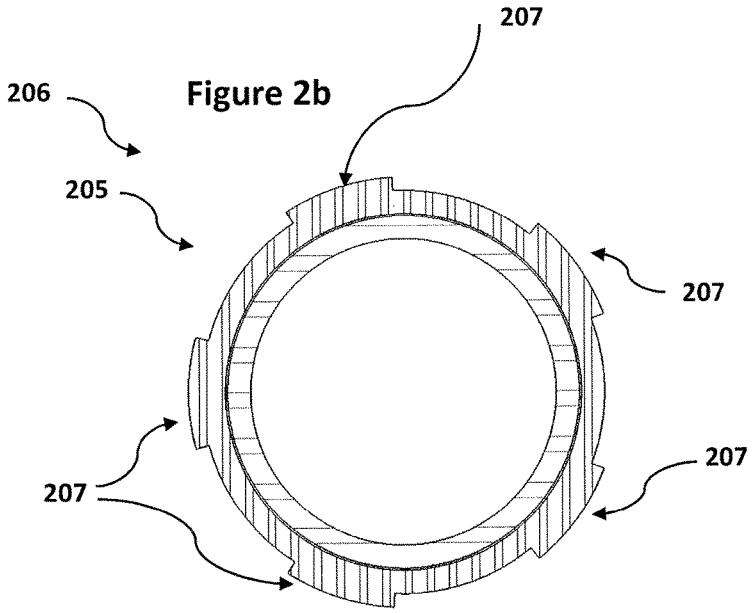

BOTTOM HOLE ASSEMBLIES FOR DIRECTIONAL DRILLING

CROSS-REFERENCE TO RELATED APPLICATION(S)

The present application claims priority to U.S. Provisional Patent Application Ser. No. 62/439,843, filed Dec. 28, 2016, the disclosure of which is incorporated herein as if set out in full. The present application is a continuation in part of patent application Ser. No. 15/667,704 Method, Apparatus By Method, And Apparatus Of Guidance Positioning Members For Directional Drilling, filed Aug. 3, 2017, the disclosure of which is incorporated herein as if set out in full.

TECHNICAL FIELD

The technology of the present application relates to improved bottom hole assemblies for directional drilling.

BACKGROUND

In the art of oil and gas well drilling, several methods exist to deviate the path of the wellbore off of vertical to achieve a target distanced from directly below the drilling rig. The methods used include traditional whipstocks, side jetting bits, modern Rotary Steerable Systems (RSS), adjustable gauge stabilizers, eccentric assemblies, turbines run in conjunction with a bent sub, and the most employed method, the bent housing Positive Displacement Motor (PDM). Variations, combinations, and hybrids exist for all of the methods listed.

The popularity of the bent housing PDM arises from its relatively low cost, general availability, familiarity to drillers, and known level of reliability. The bent housing PDM has a number of drawbacks, some of which are further described below.

A typical bent housing PDM assembly generally is made up from four primary sections. At the top is a hydraulic bypass valve called a dump sub. Frequently, the dump sub is augmented by a rotor catch mechanism designed to allow the components of the PDM to be retrieved if the outer housing fails and parts below the rotor catch. Next is the power section which is a housing containing a stator section with a lobed and spiraled central passage. A lobed and spiraled rotor shaft is deployed through the center of the power section and, in use, is caused to rotate as a result of the pressure exerted by drilling fluid pushed down through the power section. Below the power section, the PDM is fitted with a transmission and a transmission housing that incorporates a prescribed bend angle, typically 0.5 to 4.0 degrees, tilted off of the centerline of the assemblies above. The side opposite the bend angle is typically marked with a scribe and is referred to as the scribe side of the tool. It is this bend angle that primarily defines the amount of theoretical course alteration capability of the PDM steerable system. The course alteration capability of a given assembly is referred to as its "build rate" and is typically measured in calculated degrees of course change per 100 feet of drilled hole. The resulting curve of the borehole is sometimes referred to as Dog Leg Severity (DLS).

Below the transmission housing is the bearing assembly incorporating, among other things, thrust bearings, radial bearings, and a mandrel. The bearing assembly supports both axial and radial loads from above and from the bit which is typically threaded into a connection on the distal end of the bearing assembly. It should be noted that the traditional API connection of the bit to the bearing assembly comprises a considerable length which is generally deemed problematic to achieving targeted build rate.

The outer diameter of the bearing assembly is frequently mounted with a near bit stabilizer to keep the lower part of the assembly centered in the hole. A pad, typically referred to as a wear pad or kick pad, is frequently deployed at or near the outer side of the bend angle of the transmission housing. In many instances, an additional stabilizer is mounted at or near the proximate end of the power section. The stabilizer or stabilizers are typically ⅛" to ½" undersized in diameter compared to the nominal drill bit diameter and are typically concentric with the outer diameter of the component to which they are mounted. The stabilizers are undersized, in large part, to mitigate the risk of getting stuck in the hole which would be more likely with a stabilizer at full gauge, that is, as large in diameter as the drill bit.

The theoretical build rate of a bent housing motor assembly in slide mode (described further below) is traditionally determined by a "three point curvature" calculation where nominally the centerline of the bit face is the first point, the centerline of the tool at the bend/kick pad, or the midpoint of the near bit stabilizer is the second point, and the centerline of the motor top or the midpoint of the motor top stabilizer is the third point. These points work in unison to provide the fulcrum to drive the bit in the desired direction. The distance from the bit face/gauge intersection to the bend/kick pad is an aspect of the calculation. A goal of directional PDM design has been to reduce this distance because doing so theoretically enables the system to build angle at a higher rate for a given bend angle. It is important to note that three point calculations are performed on the outer bend side of the assembly, nominally operating on the "low side" of the hole or through the centerlines/midpoints as noted above. Traditional three point calculations do not take into account tool interaction with and resultant stresses engendered by contact, or over contact with the "high side" of the hole on the scribe side of the assembly.

To summarize, typical prior art PDM directional assembly types fall into three general categories. First is the slick assembly, which includes a kick/wear pad adjacent to the bend, and may include a stabilizer at the proximal end of the power section housing or on the dump sub/rotor catch assembly. The second type is the near bit stabilizer assembly which employs an under gauge stabilizer on the distal region of the bearing assembly, along with a kick/wear pad adjacent to the bend. Similarly, this second type of assembly may additionally carry a stabilizer at the proximal end of the motor housing or on the dump sub/rotor catch assembly. The third type is referred to as a "packed hole" assembly and includes, in addition to a near bit stabilizer, an additional under gauge stabilizer typically at the proximal end of the transmission housing. As with the other two types, an optional, additional under gauge stabilizer may be mounted on the proximal end of the motor housing or on the dump sub/rotor catch assembly.

The directional driller employing a bent housing PDM directs the rig to rotate the drill string including the bottom hole assembly when he feels, based on surveys or measurement information while drilling, that the well trajectory is on plan. This is called rotary mode. It produces a relatively "straight" wellbore section. It should be noted that throughout this application, where a rotary drilled section is referred to as generally straight, that the description includes sections that are not absolutely straight, because rotary drilled sections may, for example, build, drop, dip, or walk. The rotary drilled wellbore sections are generally straight in relation to the curved sections made in slide mode drilling.

When the directional surveys indicate that the well path is not proceeding at the correct inclination or azimuthal direction, the directional driller makes a correction run. He has the assembly lifted off bottom and then slowly rotated until an alignment mark at surface indicates to him that the bend angle has the bit aimed correctly for the correction run. The rotary table is then locked so that the drill string remains in a position where the bend angle (tool face) is aimed in the direction needed to correct the trajectory of the well path. As drilling fluid is pumped through the drill string, the rotor of the power section turns and rotates the drill bit. The weight on the bottom hole assembly pushes the drill bit forward along the directed path. The drill string slides along behind the bit. This is called "sliding" mode and is the steering component of the well drilling process. Once the directional driller calculates that an adequate course change has been made, he will direct the rig to resume rotating the drill string to drill ahead on the new path.

Reference is made to U.S. Pat. No. 4,729,438 to Walker et al. which describes the directional drilling process utilizing a bent housing PDM, which is incorporated herein by reference in its entirety as if set out in full.

The efficiency, predictability, and performance of bent housing PDM assemblies are negatively impacted by a number of factors. As noted by Walker et al., the components of a steerable PDM can hang-up in the borehole when the change is made from rotary mode to slide drilling. This can happen as the assembly is lifted for orientation and again when the assembly is slid forward in sliding mode with the rotary locked. The hang-up can require the application of excess weight to the assembly risking damage when the hang-up is overcome and the assembly strikes the hole bottom. The hang-up condition can occur not only at the location of the stabilizing members attached to the PDM, but also at the location of any of the string stabilizers above the motor as they pass through curved sections of wellbore.

When rotation of the drill string is stopped to drill ahead in sliding mode, the directional driller needs to be confident that the bend in the PDM has the bit pointed in the proper direction. This is known as "tool face orientation". To make an efficient course change, the tool face orientation needs to be known so the assembly can be aimed in the desired direction, otherwise the resultant section of drilling may be significantly off of the desired course. The directional driller's ability to know the tool face orientation is negatively impacted by torque and drag that result from over engagement of the drill string, and especially the stabilizers, with the borehole wall during slide mode. It also can be altered by excess weight being applied to push the assembly ahead when it is hung up. When the assembly breaks free, the bit face can be overly engaged with the rock face, over torqueing the system, and altering the tool face orientation.

Correction runs made at an improper tool face orientation take the well path further off course, requiring additional correction runs and increasing the total well bore tortuosity adding to torque and drag.

These problems are exacerbated in assemblies that use a high bend angle. Creating a well bore with a higher amount of DLS increases the amount of torque and drag acting on the drill string and bottom hole assembly. A highly tortuous well bore brings the stabilizers into even greater contact and over engagement with the borehole wall.

It is also frequently found that the amount of curvature actually achieved in slide mode by an assembly with a given bend angle is less than was predicted by the three point calculation. This causes drillers to select even higher bend angles to try to achieve a targeted build rate. Directional drillers may also select a higher bend angle in order to reduce the distance required to make a course correction allowing for longer high penetration rate rotary mode drilling sections. This overcompensation in build approach increases the overall average penetration rate while drilling the well but it also produces a problematic, excessively tortuous wellbore.

Higher bend angles put increased stress on the outer periphery of the drill bit, on the motor's bearing package, on the rotor and stator inside the motor, on the transmission housing, and on the motor housing itself. This increased stress increases the occurrence of component failures downhole. The connections between the various housings of the PDM are especially vulnerable to failures brought on by high levels of flexing and stress.

For these and additional reasons which will become apparent, a better approach to PDM geometry and configuration is needed. The present invention sets out improved technology to overcome many of the deficiencies of the prior art.

Reference is made to IADC/SPE 151248 "Directional Drilling Tests in Concrete Blocks Yield Precise Measurements of Borehole Position and Quality". In these tests, it was found that a PDM assembly with a 1.41° bend produced a 20 mm to 40 mm "lip" on the low side of the hole when transition was made from rotary to slide mode drilling in a pure build (0° scribe) section. A comparable disconformity was created on the high side of the hole in the transition from rotary to slide mode drilling with the assembly oriented in slide down. These lips can account for some of the "hang-up" experienced in these transitions. IADC/SPE 151248 is incorporated by reference in its entirety.

Reference is also made to the proposed use of eccentric stabilizers in directional drilling, either in non-rotating configurations, or on steerable PDMs as a biasing means, alone or in conjunction and alignment with a bent housing. A specific reference in this area of art is the aforementioned Walker reference. Additional references include U.S. Pat. Nos. 2,919,897; 3,561,549; and 4,465,147 all of which are incorporated by reference in their entirety.

Reference is also made to U.S. patent application Ser. No. 15/430,254, filed Feb. 10, 2017, titled "Drilling Machine", which is incorporated herein by reference as if set out in full, which describes, among other things, a Cutter Integrated Mandrel (CIM). The CIM technology may be advantageously employed in connection with the current technology. In addition, the Dynamic Lateral Pad (DLP) technology of the referenced application may also be advantageously employed in connection with the current technology. The "Drilling Machine" application is assigned to the same assignee as the current application and is incorporated by reference in its entirety.

The bottom hole assembly technologies of the present application can also be mounted on adjustable diameter mechanisms such as are used on Adjustable Gauge Stabilizers, as are known in the art. A non-limiting example is U.S. Pat. No. 4,848,490 to Anderson which is incorporated by reference in its entirety.

SUMMARY

The technology of the present application discloses new bent housing PDM directional drilling assemblies operating in and interacting with curved and generally straight hole wellbores. Employing these technologies allows for the creation of novel assembly positioning elements that can replace or modify traditional near bit stabilizer and upper stabilizer components on a directional PDM assembly. The technology of the present application is based on the newly modeled observation that traditional 3 point calculations and BHA modeling fail to take into account the complete set of geometries of a steerable system operating in a curved well bore. These novel assemblies provide the needed support for the steering fulcrum effect while minimizing the production of torque, drag, and hang-up such as is attendant in the prior art.

The technology of the present application consistently employs a positioning element proximal of the bend generally on the upper (proximal) end of the transmission housing. This positioning element incorporates a primary outer positioning surface or surfaces on the scribe side of the tool and may include raised secondary surfaces on the bend side of the tool. Both the primary outer positioning surface or surfaces and the secondary surfaces, if any share the centerline of the tool, are circumferentially deployed. The most extended primary outer positioning surfaces are radially distanced from the tool centerline by a factor greater than or equal to 0.91 and less than or equal to 1.05 of the nominal bit radius of the assembly. The outer surfaces of the secondary surfaces are radially distanced from the tool centerline by a factor of less than or equal to 0.90 of the nominal bit radius of the assembly, but no less than the radius of the tool housing.

For instance, on an assembly with an 8.750 inch diameter (4.375 radius) bit and a 7.000 inch diameter (3.500 radius) transmission housing, the outer surfaces of the primary positioning zone would lie on an arc distanced from the centerline of the tool by a value of between 3.981 inch and 4.593 inch. The outer surface or surfaces of the secondary zone would lie on an arc distanced from the centerline of the tool by a value of between 3.500 (no blade extension, just the housing outer surface) and 3.937 inch. Generally, the closer the primary positioning surfaces are to the minimum value, in this case 3.981 inch, the closer the secondary positioning surfaces will be to the minimum value for the secondary positioning zone, in this case 3.500 inch.

Where the technology of the present application also includes a near bit positioning element, said element would typically be sleeve mounted distal of the bend typically on the bearing housing. On a near bit positioning element, the outer primary surfaces of the positioning element are on the bend side of the directional drilling assembly and the secondary surfaces, if any, are on the scribe side of the assembly. On an exemplary assembly with an 8.750 drill bit diameter, the radial values for the primary outer surfaces are in the same range as previously noted, between 3.981 inch and 4.593 inch. In this example, the sleeve body diameter is 7.500 inch yielding a secondary zone value between 3.75 inch radius (no blade extension) and 3.937 inch (0.90 of nominal bit radius).

An observation in the development of the technologies of the present application is that rather than simply looking at a presumed set of contact points for a three point calculation, a modeling of the axial centerline of the bottom hole assembly housings in a BHA with a given bend angle and under the loads of slide mode drilling better informs the design and deployment of outer BHA elements to achieve the desired build rate. Traditional 3 point calculations have left system designers and directional drillers questioning why directional drilling assemblies have failed to deliver the predicted build rate or failed to deliver a consistent build rate. An additional critical observation made by the applicants of the present application is that when a traditional bent housing bottom hole assembly has made a slide section and is returned to rotary drilling mode, the contact loads on the proximal surfaces of the distal (near bit) stabilizer are exceedingly high. These loads can be greater than 65,000 lbs. during the course of the first or first several rotations of the assembly. The pads of the subject near bit stabilizer see the highest stresses at the top side of the bore hole as the bend side of the assembly is rotated around and the bend side pads strike the top borehole surface.

These forces are great enough to bring about tool failure through shock or fatigue loading. The contact loads experienced by the near bit stabilizer are translated into bending loads in the motor housing and assembly connections. In order to address the deficiencies of prior art bottom hole directional assemblies discussed above, the developers of the technology of the present application have created a series of alternative bottom hole assembly designs. The primary goal of these technologies is to provide bottom hole assembly elements which maintain the centerline of the assembly at or near the bend angle at or below the hole centerline position. In some embodiments, the technologies of the present application additionally address the high contact loads experienced by the near bit stabilizer in the transition from slide to rotary mode drilling. At discretion of the system designer, additionally polycrystalline diamond compact (PDC) or tungsten carbide cutters may be deployed on the distal surfaces of the assembly elements. These cutters may be deployed in any orientation as is known in the art, to cut in shear in rotary mode, or to plow in sliding mode. The purpose of these cutters is to better enable the assembly elements to address transiting the transition lips identified in IADC/SPE 151248 referenced above. Although PDC or tungsten carbide cutters have been noted here, any suitable cutting element known in the art may be deployed for this purpose.

The system designer can choose the number of flutes, if any, and method of wear protection of the assembly elements. The system designer can choose whether to use straight or spiraled blades on his positioning assemblies.

The system designer may produce computer machining files needed to machine or fabricate by subtractive or additive manufacturing techniques the assembly elements that will be deployed on the Bottom Hole Assembly. This description is not meant to limit the manufacturing techniques that may be chosen to create the bottom hole assemblies of the application. Any manufacturing method, including welding, grinding, turning, milling, or casting or any other method known in the art may be used.

The development of the above design method was made by the inventors of the present technology observing that traditional near gauge stabilizers unnaturally force the assembly towards the center of the hole. This unnatural positioning of the drilling assembly causes the assembly to disadvantageously push the prior art stabilizers into over engagement with the bore hole wall, damaging and enlarging the wall and creating accelerated wear on the stabilizers. By forcing the assembly into an unnatural position, increased stress and load is placed on the housings of the assembly increasing the likelihood of fatigue failure. It also adds significantly to the problems of drag in sliding mode and torque and drag in rotary mode.

Another observation made during the development of this technology is that in at least some, and potentially many, instances additional contact occurs on the high side (scribe side) of the assembly in slide mode. It has been observed that this high side contact can move during the slide due to deflection and may occur at various times from the upper end of the transmission housing to points all up and down the motor housing. These shifting high side contact points can dramatically and unpredictably alter the build characteristics of the assembly. To address this condition, the system designer employing the technology of the present application will place an assembly positioning element on the high side of the assembly proximal of the bend to increase the likelihood of the high side contact being limited to a single, predictable and calculable point.

The technology is also applicable to combined RSS Motor systems.

It is an object of the technology of the present application to create smoother wellbores. This includes smoother build sections and less tortuous horizontal sections.

It is an object of the technology of the present application to improve the effectiveness of bend elements in directional PDM assemblies, allowing for the use of less aggressive bend angles to achieve a given build rate. Using a less aggressive bend angle reduces the amount of hole oversize created in the rotate drilling mode, reducing operational costs. Using a less aggressive bend angle reduces the loads and stresses on the outer periphery of drill bits used in directional drilling PDM assemblies, improving the life and performance of the bits. Employing the current technology with the Cutter Integrated Mandrel technology referred to above allows for even less aggressive bend angles for a given build rate.

It is an object of the technology of the present application to produce directional wellbores requiring fewer correction runs.

It is an object of the technology of the present application to reduce torque and drag generated by the interaction of a directional PDM assembly with the wellbore.

It is an object of the technology of the present application to allow for longer lateral sections to be drilled through the reduction in tortuosity, torque, and drag resulting from the use of the technology.

It is an object of the technology of the present application to increase the flow path for drilling fluid and cuttings past the outer members of a directional PDM assembly.

It is an object of the technology of the present application to increase the rate of penetration in drilling operations utilizing directional PDM assemblies. This is accomplished by increasing the ratio of rotary drilling mode to sliding drilling mode and by making the drilling occurring in rotary mode and, especially in slide drilling mode, more effective.

It is an object of the technology of the present application to improve the predictability and certainty of tool face orientation reducing the number and length of correction runs required for a given directional well.

It is an object of the technology of the present application to reduce the amount of stress, deflection, and load placed on the various components of a directional drilling PDM assembly.

It is an object of the technology of the present application to reduce the wear rate on bits used on directional drilling assemblies by allowing for less aggressive bend angles.

It is an object of the technology of the present application to provide appropriate support, and fulcrum effect to a directional drilling PDM assembly rather than detrimental centralization or stabilization of the prior art.

It is an object of the technology of the present application to reduce in size and more effectively transit the transition lips existing in directional wellbores at the transition from rotary to slide mode drilling and from slide mode to rotary drilling.

It is an object of the technology of the present application to allow for even higher build rates than traditional directional drilling PDM assemblies.

It is an object of the technology of the present application to provide improved performance of Rotary Steerable Systems that utilize PDM motors.

It is an object of the technology of the present application to provide positioning BHA elements that can replace traditional stabilizers utilized on other BHA components or on drill string.

BRIEF DESCRIPTION OF THE DRAWINGS

FIG. 2 shows a side view of a prior art near bit partially stabilized steerable PDM directional assembly.

FIG. 2*a* shows a cross section view of the kick/wear pad of the prior art assembly of FIG. 2.

FIG. 2*b* shows a cross section view of the near bit stabilizer of the prior art assembly of FIG. 2.

DETAILED DESCRIPTION

Figure 1:
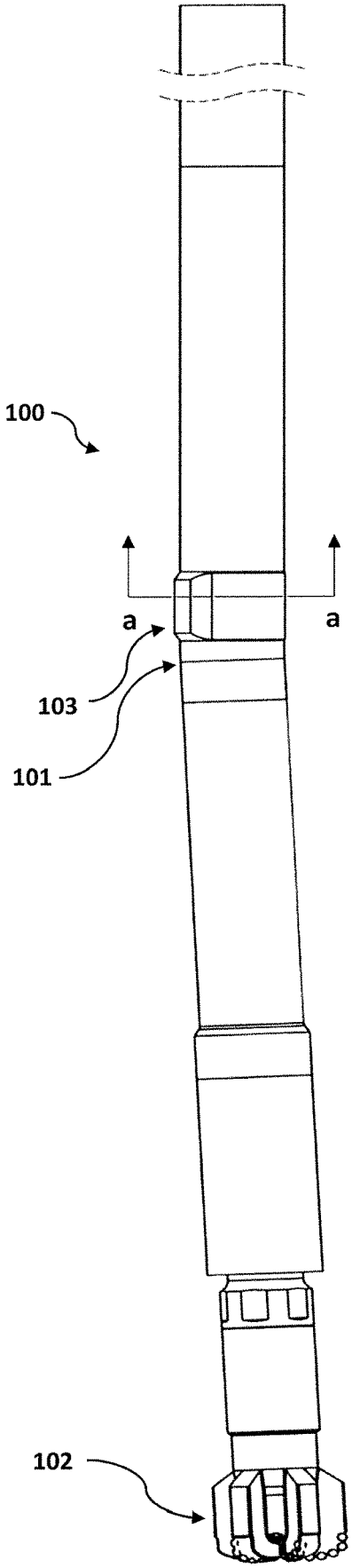
Figure 1 Prior Art
FIG. 1 shows a side view of a prior art slick assembly steerable PDM directional assembly.

FIG. 1 shows a side view of a prior art slick assembly steerable PDM directional assembly 100. Assembly 100 includes bend 101, drill bit 102, and kick/wear pad 103.

Figure 1A:
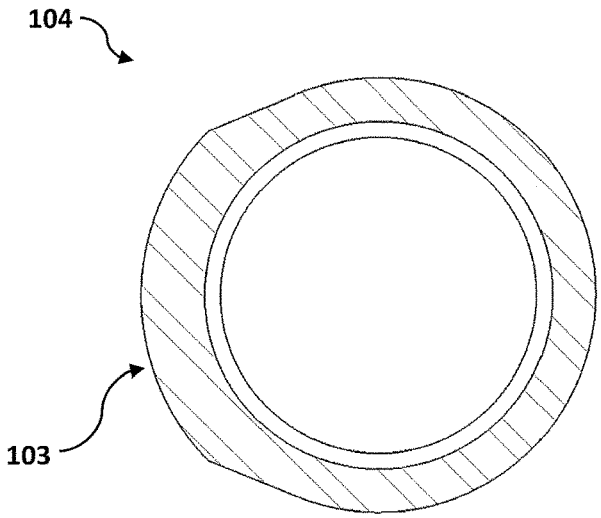
FIG. 1*a* shows a cross section view of the kick/wear pad of the prior art assembly of FIG. 1.

FIG. 1*a* shows a cross section 104 of kick/wear pad 103 taken across a-a of FIG. 1.

FIG. 2 shows a side view of a prior art near bit stabilized steerable PDM directional assembly 200. Assembly 200 includes bend 101, drill bit 102, and kick/wear pad 103. It also includes near bit stabilizer 205.

FIG. 2*a* shows a cross section 104 of kick/wear pad 103 taken across a-a of FIG. 2.

FIG. 2*b* shows a cross section 206 of near bit stabilizer 205 taken across b-b of FIG. 2 with symmetric circumferential blades shown at 207.

Figure 3:
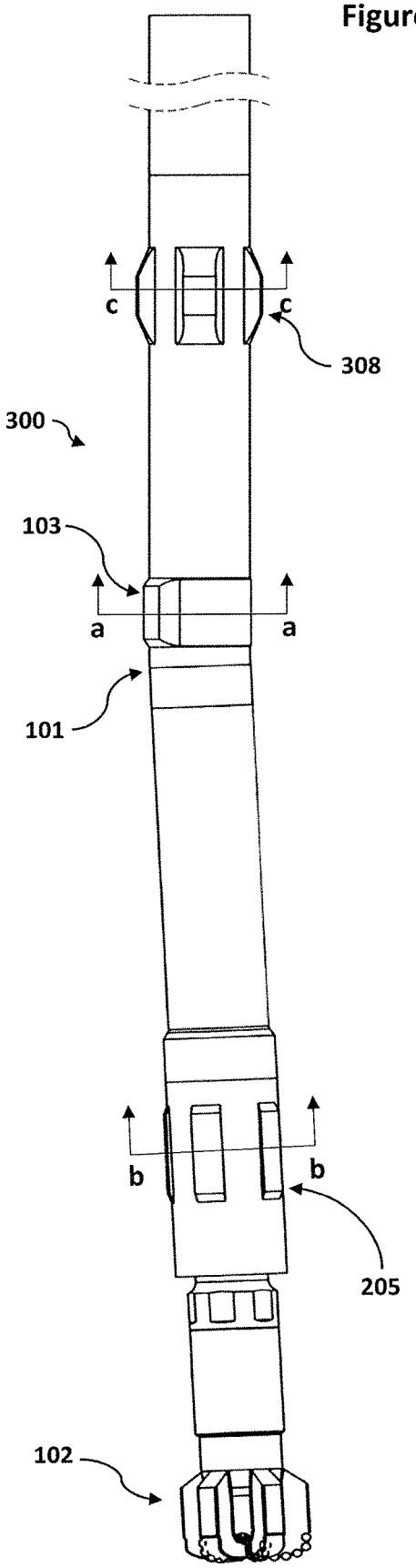
FIG. 3 shows a side view of a prior art fully stabilized steerable PDM directional assembly.

FIG. 3 shows a side view of a prior art fully stabilized steerable PDM directional assembly 300. Assembly 300 includes bend 101, drill bit 102, and kick/wear pad 103. It also includes near bit stabilizer 205 and above bend stabilizer 308.

Figure 3C:
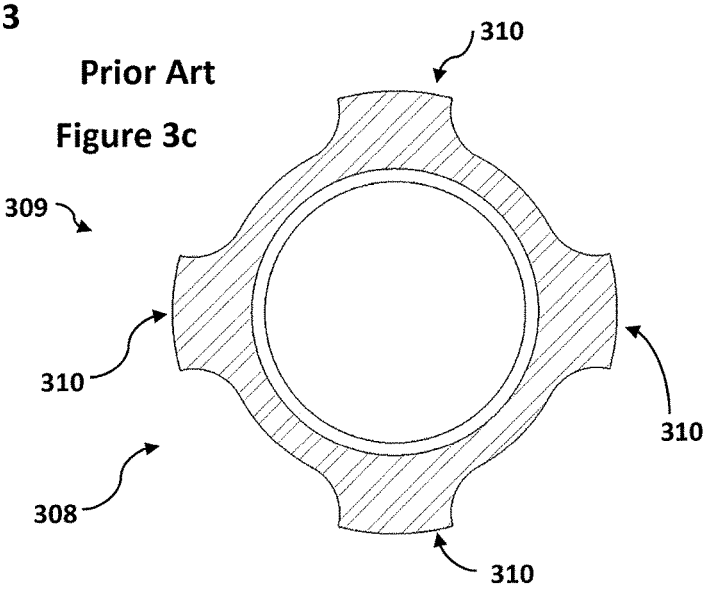
Prior Art Figure 3c
FIG. 3*c* shows a cross section view of the upper stabilizer of the prior art assembly of FIG. 3.
Figure 3A:
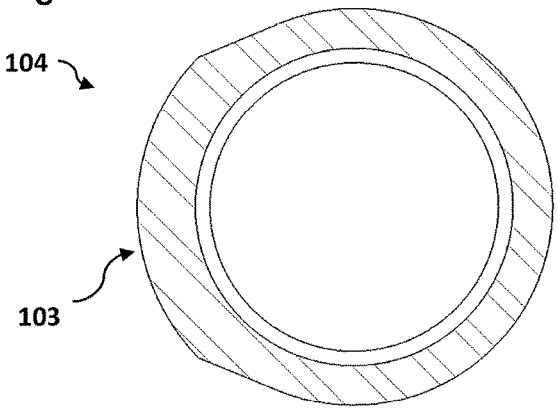
FIG. 3*a* shows a cross section view of the kick/wear pad of the prior art assembly of FIG. 3.

FIG. 3*a* shows a cross section 104 of kick/wear pad 103 taken across a-a of FIG. 3.

Figure 3B:
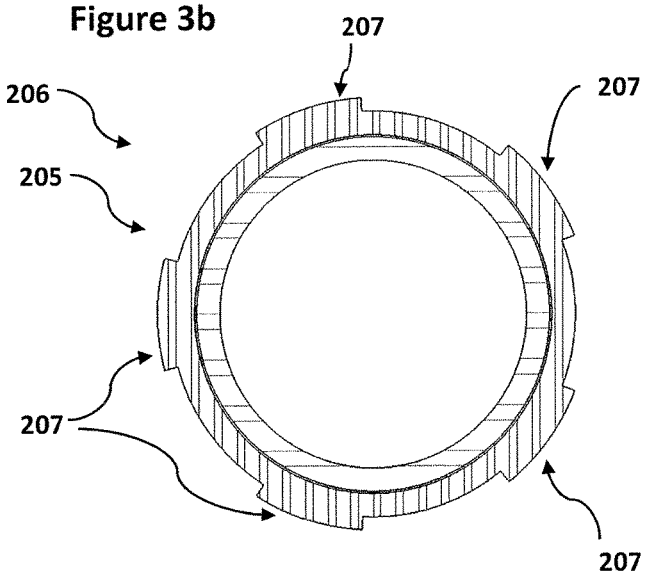
FIG. 3*b* shows a cross section view of the near bit stabilizer of the prior art assembly of FIG. 3.

FIG. 3*b* shows a cross section 206 of near bit stabilizer 205 taken across b-b of FIG. 3 with symmetric circumferential blades shown at 207.

FIG. 3*c* shows a cross section 309 of above bend stabilizer 308 taken across c-c of FIG. 3 with symmetric circumferential blades shown at 310.

Figure 4:
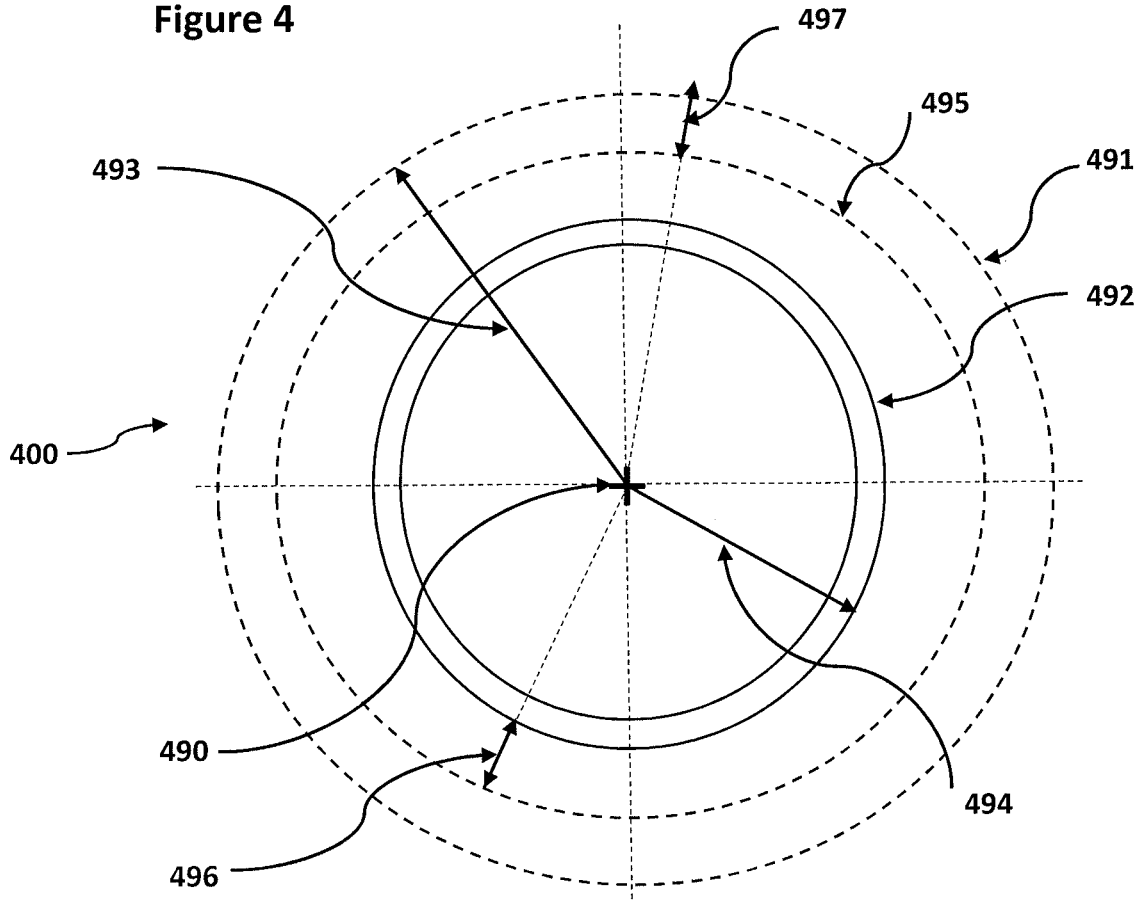
FIG. 4 shows a generalized cross section view of aspects of the technology of the steerable PDM directional assembly of this application.

FIG. 4 shows a generalized cross section view 400 of aspects of the technology of the steerable PDM directional assembly of this application. FIG. 4 shows center point 490, nominal bit diameter 491, housing or sleeve minor diameter 492, nominal bit radius 493, and nominal housing or sleeve minor radius 494. FIG. 4 also shows demarcation diameter 495. Radial zone 496 falls inside the demarcation diameter 495 and covers the zone of maximum radial surface of a secondary positioning element structure of a given near bit or above bend positioning element. In the technology of the present application, radial zone 496 is greater than or equal to the housing or sleeve minor diameter 492 and is less than or equal to 0.90 of the nominal bit radius 493. Radial zone 497 falls outside the demarcation diameter 495 and covers the zone of maximum radial surface of a primary positioning element structure of a given near bit or above bend positioning element. In the technology of the present application, radial zone 497 is greater than or equal to 0.91 of the nominal bit radius 493 and less than or equal to 1.05 of the nominal bit radius 493. From the above description, it can be seen that the demarcation diameter 495 occupies the narrow zone between 0.90 and 0.91 of the nominal bit radius 493.

Figure 5:
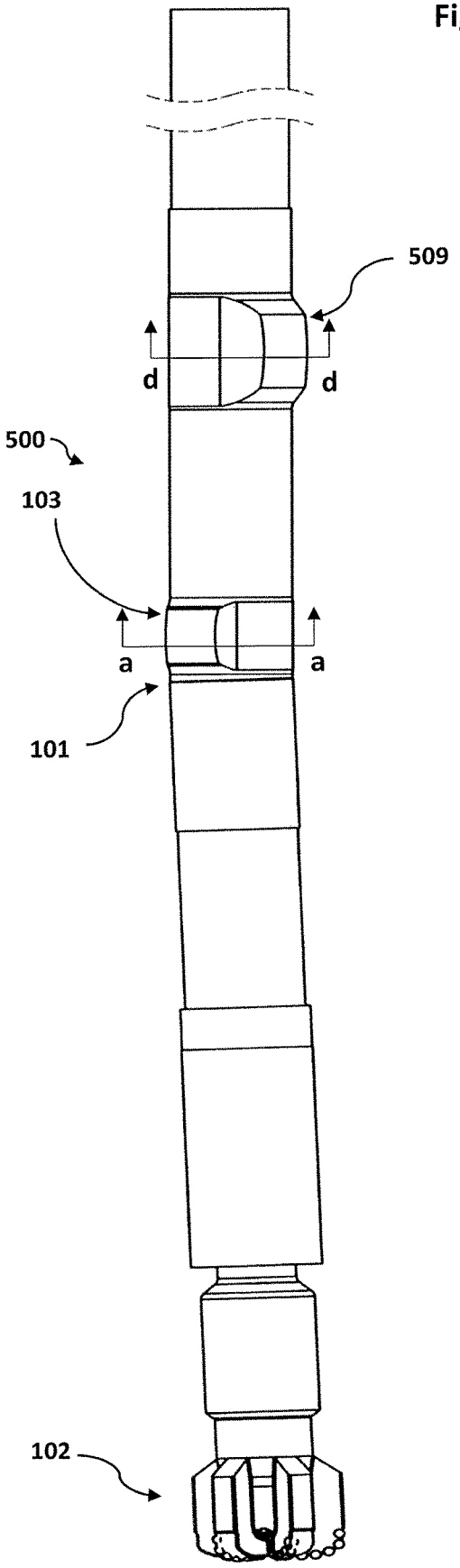
FIG. 5 shows a side view of an embodiment of a modified steerable PDM directional assembly consistent with the technology of the present application.

FIG. 5 shows a side view of an assembly 500 consistent with one embodiment of the technology of the present application. Assembly 500 includes bend 101, drill bit 102, and kick/wear pad 103. It also shows above bend positioning element 509.

Figure 5D:
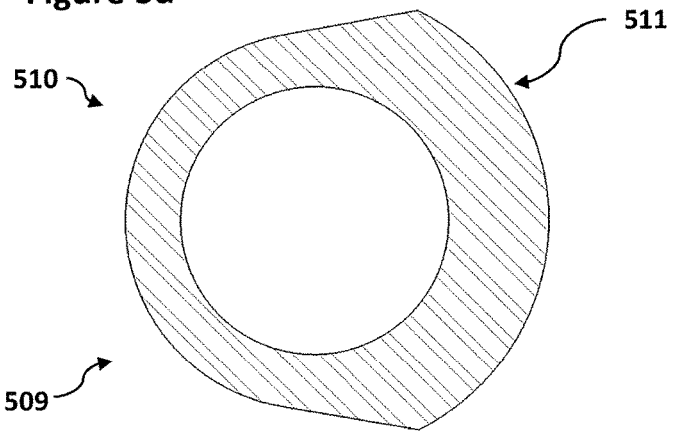
FIG. 5*d* shows a cross section view of a scribe side above bend enlarged primary structure radius positioning element consistent with the technology of the present application.
Figure 5A:
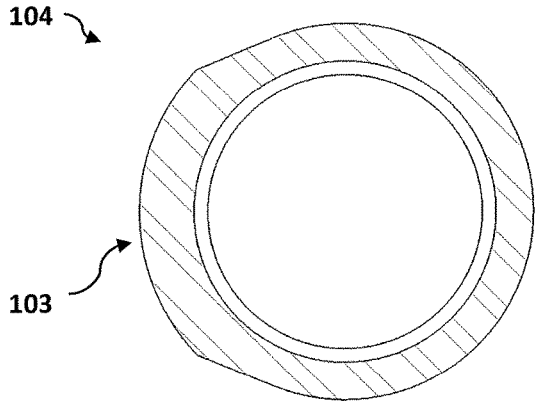
FIG. 5*a* shows a cross section view of the near bend kick/wear pad of FIG. 5.

FIG. 5*a* shows cross section 104 of kick/wear pad 103 taken across a-a of FIG. 5.

FIG. 5*d* shows cross section 510 of above bend positioning element 509 taken across d-d of FIG. 5. FIG. 5*d* also shows primary positioning element structure 511.

Figure 6:
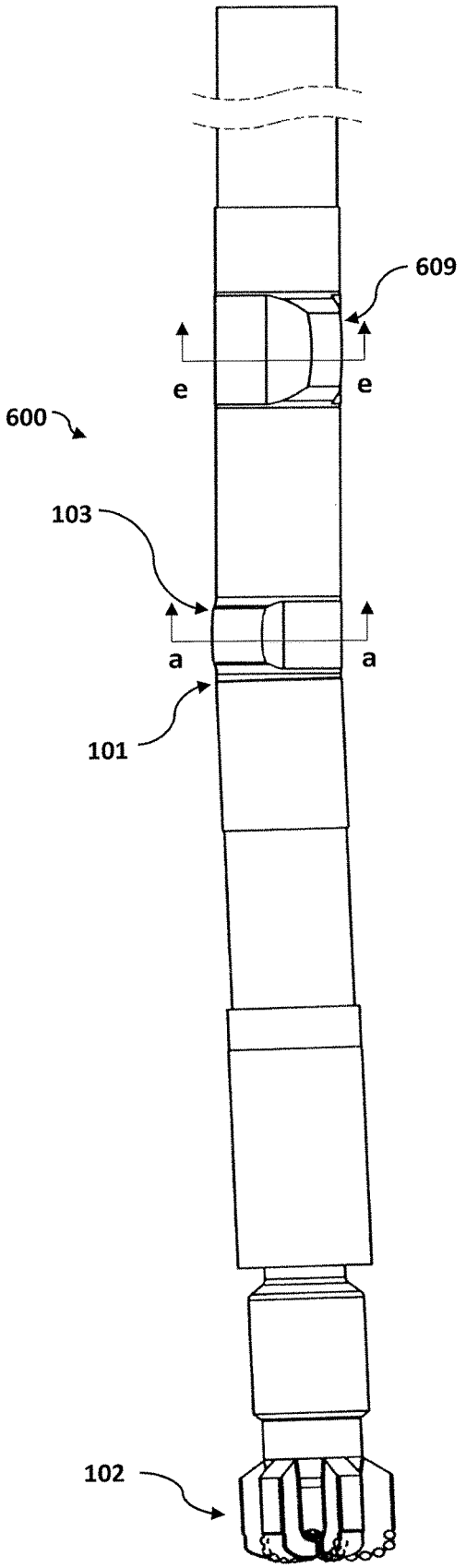
FIG. 6 shows a side view of an alternative embodiment of a modified steerable PDM directional assembly consistent with the technology of the present application.

FIG. 6 shows a side view of an assembly 600 consistent with another embodiment of the technology of the present application. Assembly 600 includes bend 101, drill bit 102, and kick/wear pad 103. Assembly 600 also shows above bend positioning element 609.

Figure 6E:
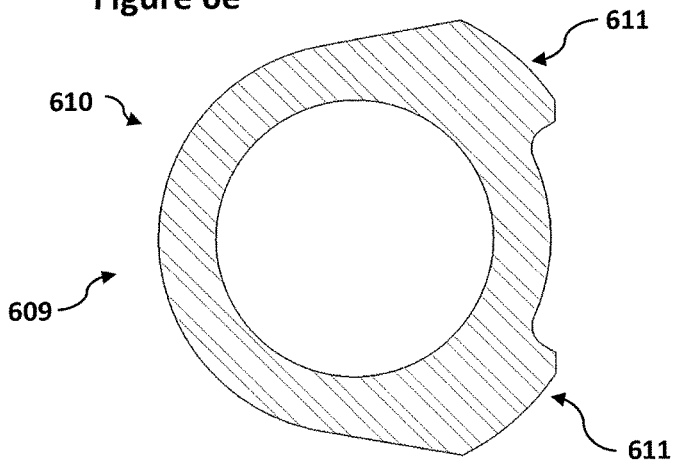
FIG. 6*e* shows a cross section view of an alternative embodiment of a scribe side above bend enlarged primary structure radius positioning element consistent with the technology of the present application.
Figure 6A:
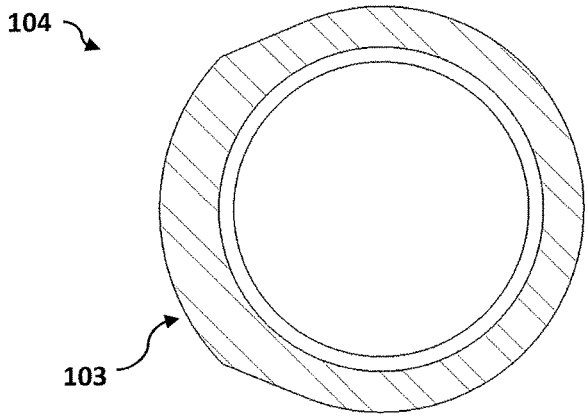
FIG. 6*a* shows a cross section view of the near bend kick/wear pad of FIG. 6.

FIG. 6*a* shows cross section 104 of kick/wear pad 103 taken across a-a of FIG. 6.

FIG. 6*e* shows cross section 610 of above bend positioning element 609 taken across e-e of FIG. 6. FIG. 6*e* also shows primary positioning element structure blades 611.

Figure 7:
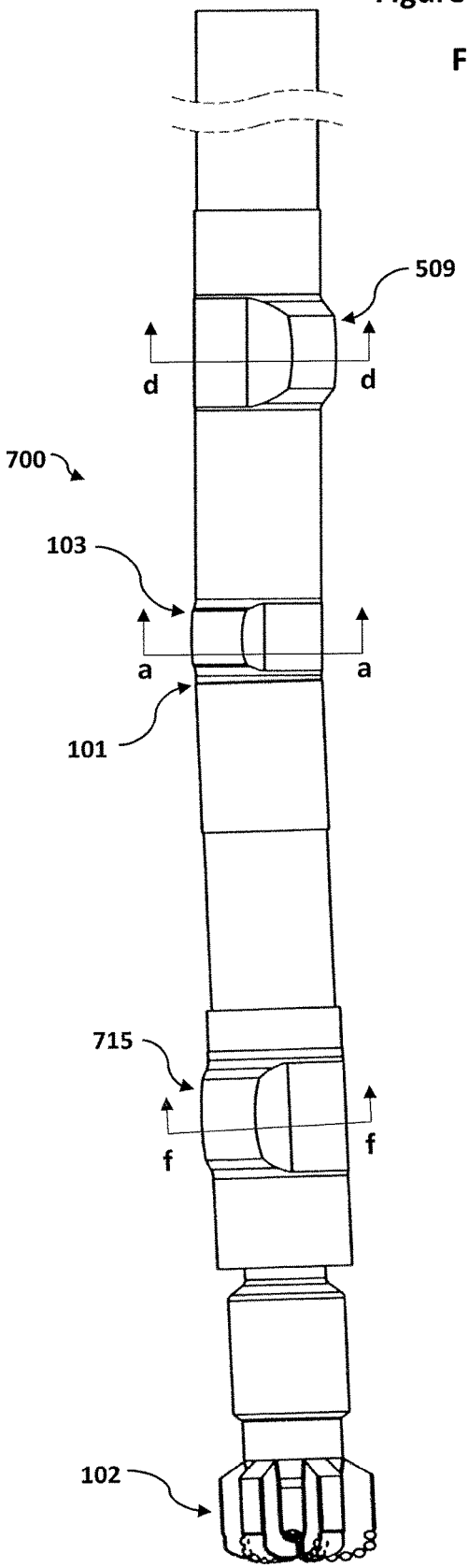
FIG. 7 is a side view of a modified steerable PDM directional assembly incorporating both a scribe side above bend enlarged primary structure radius positioning element and a bend side enlarged primary structure radius lower sleeve positioning element consistent with the technology of the present application.

FIG. 7 shows a side view of an assembly 700 consistent with another embodiment of the technology of the present application. Assembly 700 includes bend 101, drill bit 102, and kick/wear pad 103. Assembly 700 also shows above bend positioning element 509. Assembly 700 also shows near bit positioning element 715. It should be noted that kick/wear pad 103 is optional at designer discretion in the embodiment of FIG. 7.

Figure 7D:
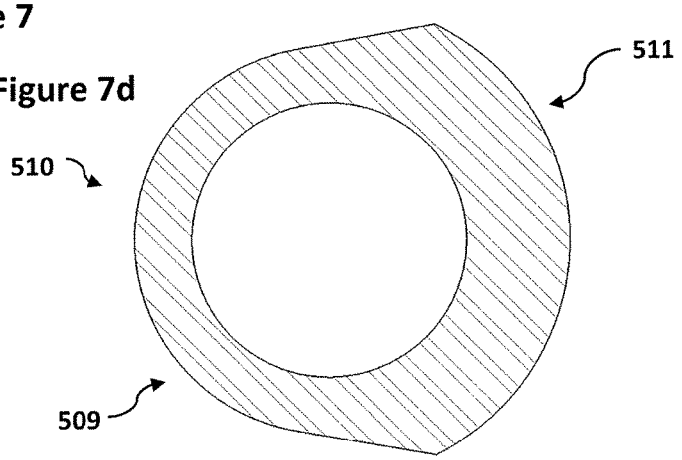
FIG. 7*d* shows a cross section view of an embodiment of a scribe side above bend enlarged primary structure radius positioning element consistent with the technology of the present application.
Figure 7A:
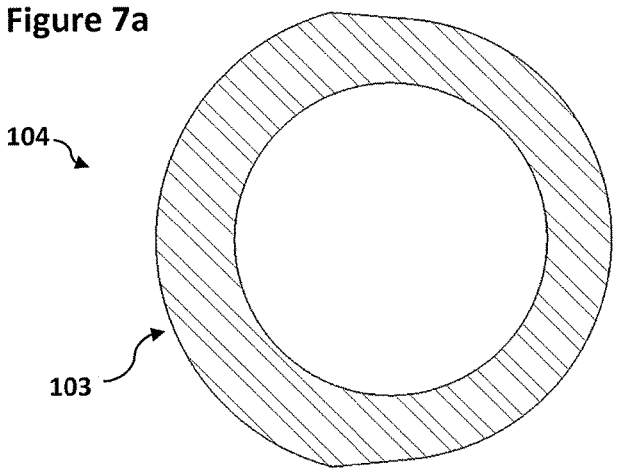
FIG. 7*a* shows a cross section view of the near bend kick/wear pad of FIG. 7.

FIG. 7*a* shows cross section 104 of kick/wear pad 103 taken across a-a of FIG. 7. It should be noted that kick/wear pad 103 is optional at designer discretion in the embodiment of FIG. 7.

FIG. 7*d* shows cross section 510 of above bend positioning element 509 taken across d-d of FIG. 7. FIG. 7*d* also shows primary positioning element structure 511.

Figure 7F:
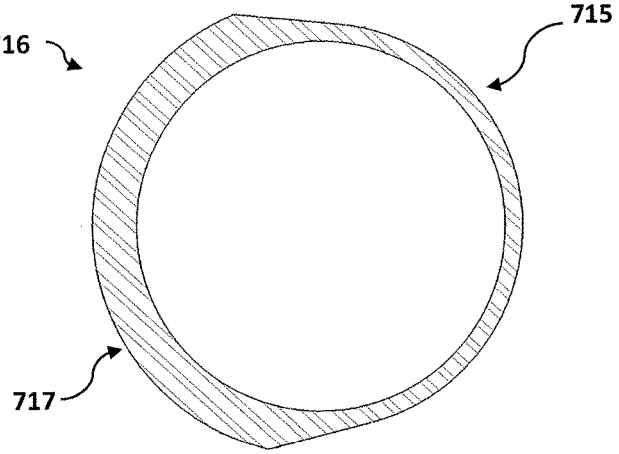
FIG. 7*f* shows a cross section view of a bend side enlarged primary structure radius lower sleeve element consistent with the technology of the present application.

FIG. 7*f* shows cross section 716 of near bit positioning element 715 taken across f-f of FIG. 7. FIG. 7*f* also shows primary positioning element structure 717.

Figure 8:
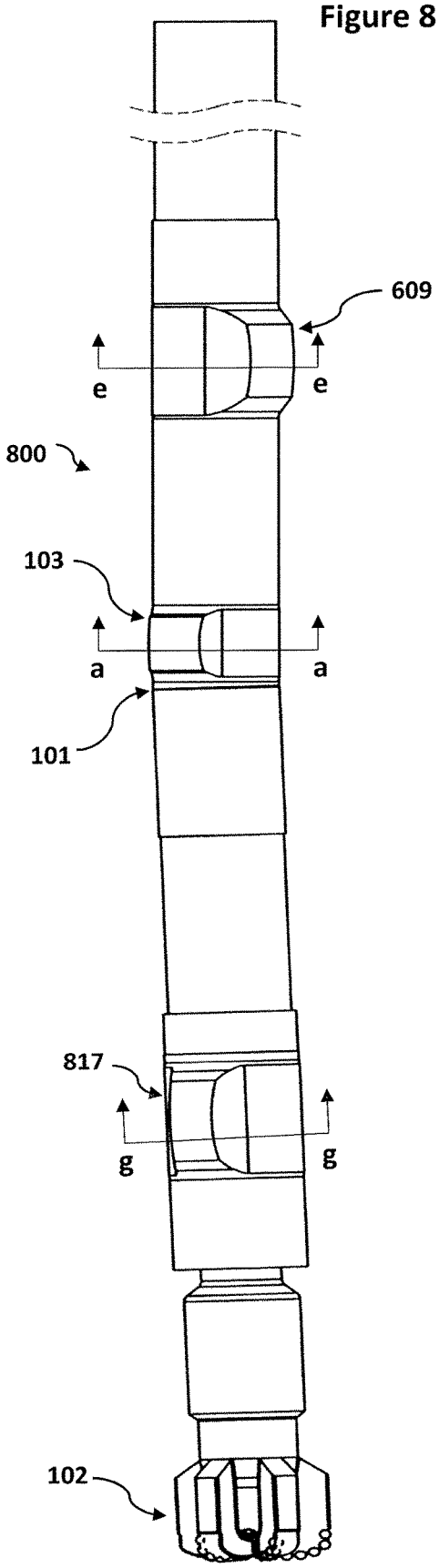
FIG. 8 shows a side view of a modified steerable PDM directional assembly incorporating both a scribe side above bend enlarged primary structure radius positioning element and a bend side enlarged primary structure radius lower sleeve positioning element consistent with the technology of the present application.

FIG. 8 shows a side view of an assembly 800 consistent with another embodiment of the technology of the present application. Assembly 800 includes bend 101, drill bit 102, and kick/wear pad 103. Assembly 800 also shows above bend positioning element 609. Assembly 800 also shows near bit positioning element 817. It should be noted that kick/wear pad 103 is optional at designer discretion in the embodiment of FIG. 8.

Figure 8E:
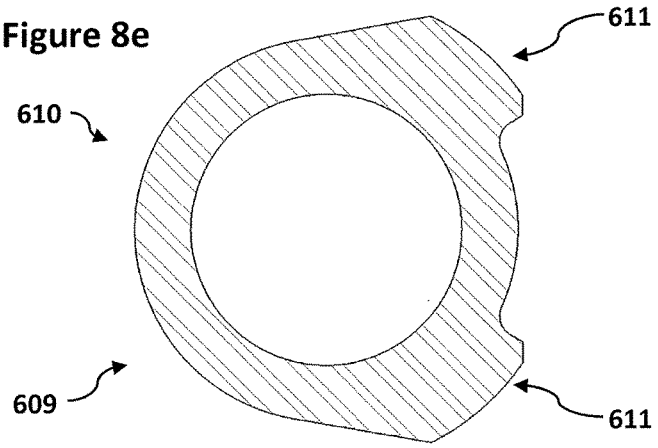
FIG. 8*e* shows a cross section view of an alternative embodiment of a scribe side above bend enlarged primary structure radius positioning element consistent with the technology of the present application.
Figure 8A:
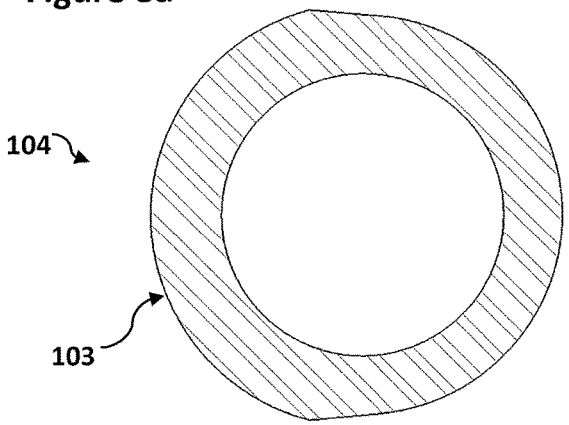
FIG. 8*a* shows a cross section view of the near bend kick/wear pad of FIG. 8.

FIG. 8*a* shows cross section 104 of kick/wear pad 103 taken across a-a of FIG. 8. It should be noted that kick/wear pad 103 is optional at designer discretion in the embodiment of FIG. 8.

FIG. 8*e* shows cross section 610 of above bend positioning element 609 taken across e-e of FIG. 8. FIG. 8*e* also shows primary positioning element structure blades 611.

Figure 8G:
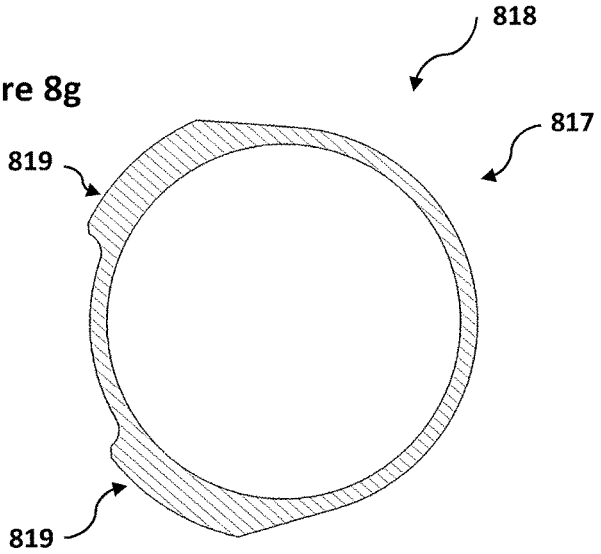
FIG. 8*g* shows a cross section view of an alternative embodiment of a bend side enlarged primary structure radius lower sleeve element consistent with the technology of the present application.

FIG. 8*g* shows cross section 818 of near bit positioning element 817 taken across g-g of FIG. 8. FIG. 8*g* also shows primary positioning element structure blades 819.

Figure 9I:
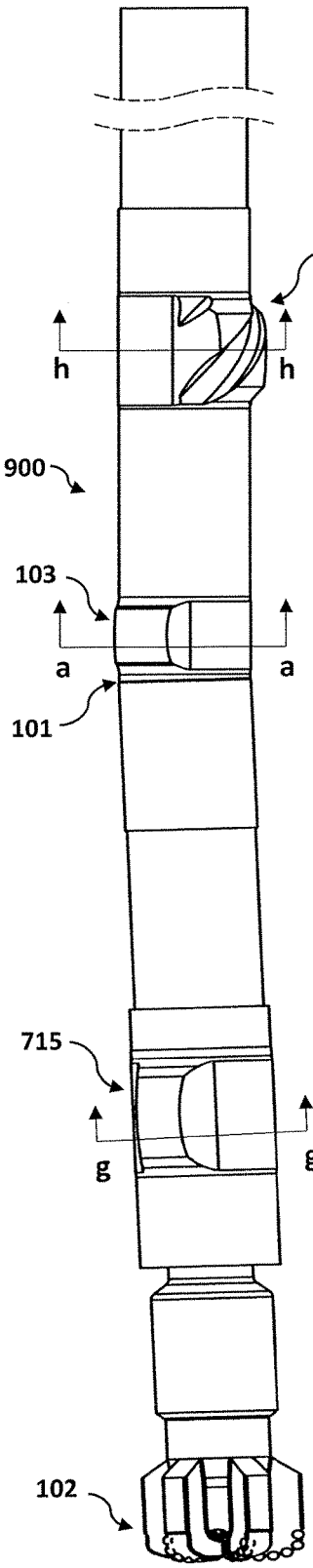
FIG. 9*i* shows a side view of a modified steerable PDM directional assembly incorporating a spiraled blade scribe side above bend primary structure radius positioning element and a bend side primary structure radius lower sleeve positioning element consistent with the technology of the present application.

FIG. 9*i* shows a side view of an assembly 900 consistent with another embodiment of the technology of the present application. Assembly 900 includes bend 101, drill bit 102, and kick/wear pad 103. Assembly 900 also shows above bend positioning element 919. Assembly 900 also shows near bit positioning element 715. It should be noted that kick/wear pad 103 is optional at designer discretion in the embodiment of FIG. 8.

Figure 9J:
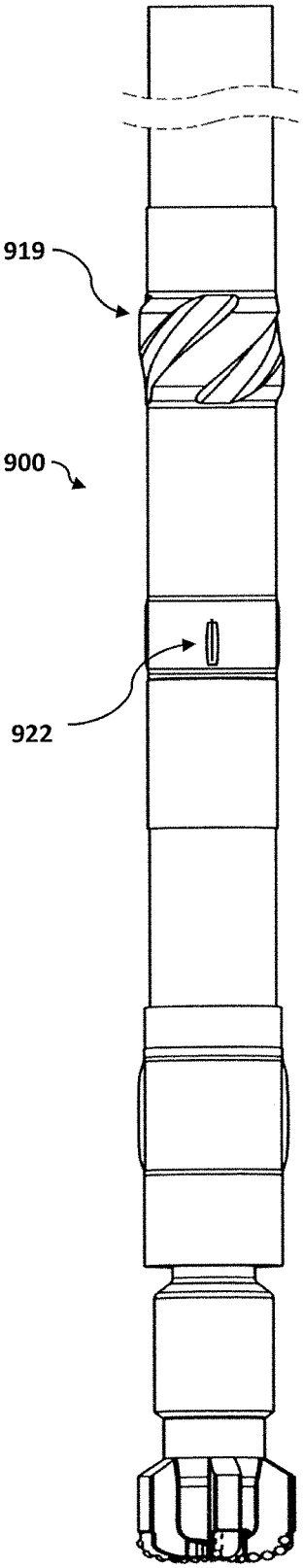
FIG. 9*j* shows a scribe side view of the modified steerable PDM directional assembly of FIG. 9*i*.
Figure 9H:
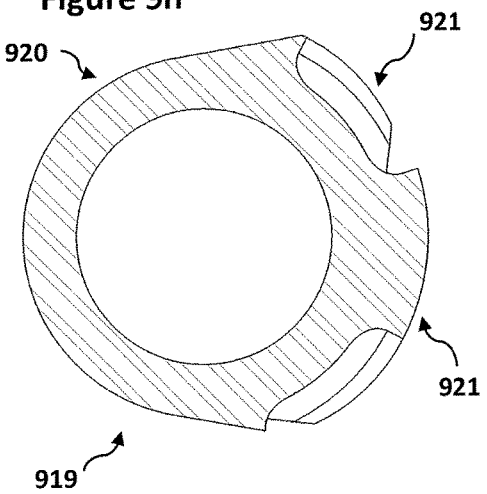
FIG. 9*h* shows a cross section view of an alternative embodiment of a spiraled scribe side above bend enlarged primary structure radius positioning element consistent with the technology of the present application.
Figure 9A:
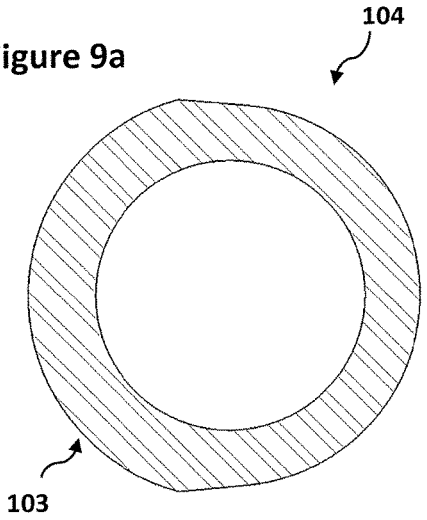
FIG. 9*a* shows a cross section view of the near bend kick/wear pad of FIG. 9*i*.

FIG. 9*a* shows cross section 104 of kick/wear pad 103 taken across a-a of FIG. 9*i*. It should be noted that kick/wear pad 103 is optional at designer discretion in the embodiment of FIG. 9*i*.

Figure 9G:
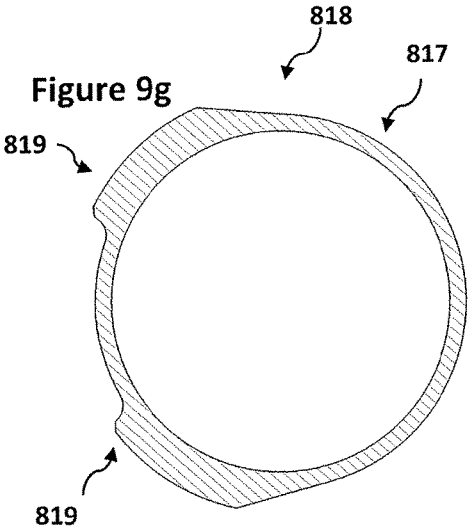
FIG. 9*g* shows a cross section view of an alternative embodiment of a bend side enlarged primary structure radius lower sleeve element consistent with the technology of the present application.

FIG. 9*g* shows cross section 818 of near bit positioning element 817 taken across g-g of FIG. 9*i*. FIG. 9*g* also shows primary positioning element structure blades 819.

FIG. 9*h* shows cross section 920 of above bend positioning element 919. FIG. 9*h* also shows spiraled primary positioning element structure blades 921.

FIG. 9*j* shows a scribe side view of assembly 900. FIG. 9*j* also shows scribe side of above bend positioning element 919 and scribe mark 922.

Figure 10A:
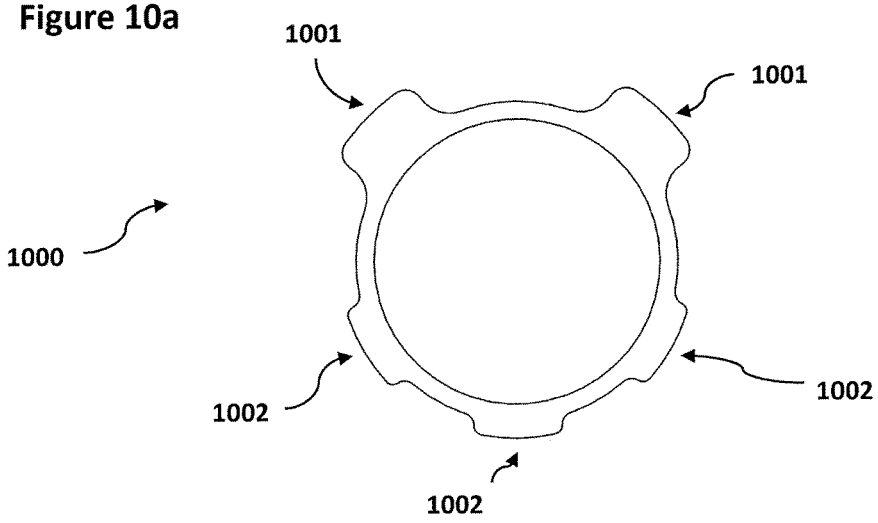
FIG. 10*a* shows a cross section of an alternative embodiment of a positioning element of the technology.

FIG. 10*a* shows a cross section of an assembly 1000 of an alternative embodiment of a positioning element of the technology. Assembly 1000 includes two primary positioning element structure surfaces at 1001 and three secondary positioning element structure surfaces at 1002.

Figure 10B:
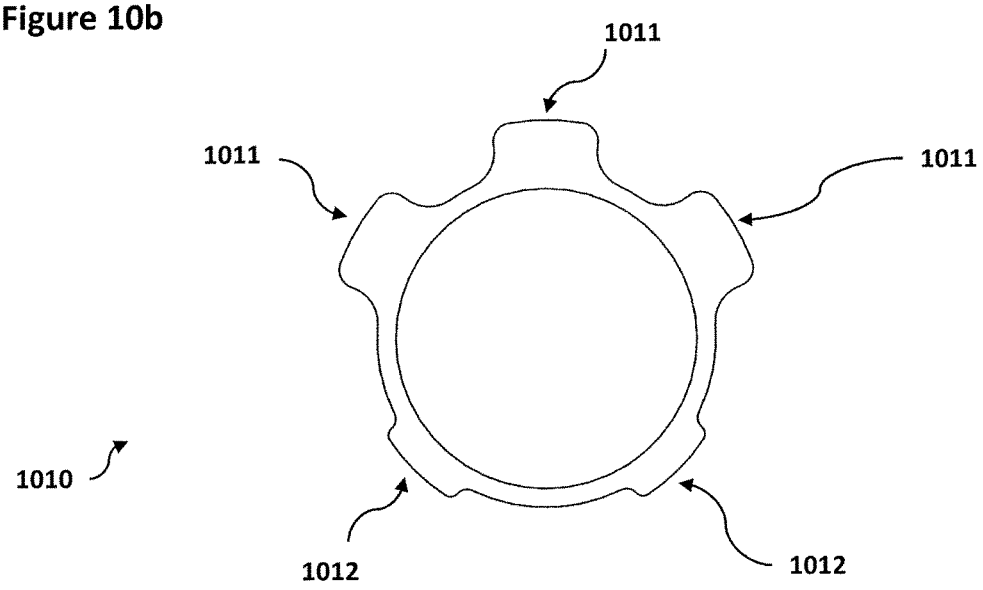
FIG. 10*b* shows a cross section of an additional alternative embodiment of a positioning element of the technology.

FIG. 10*b* shows a cross section of an assembly 1010 of an additional alternative embodiment of a positioning element of the technology. Assembly 1010 includes three primary positioning element structure surfaces at 1011 and two secondary positioning element structure surfaces at 1012.

Figure 10C:
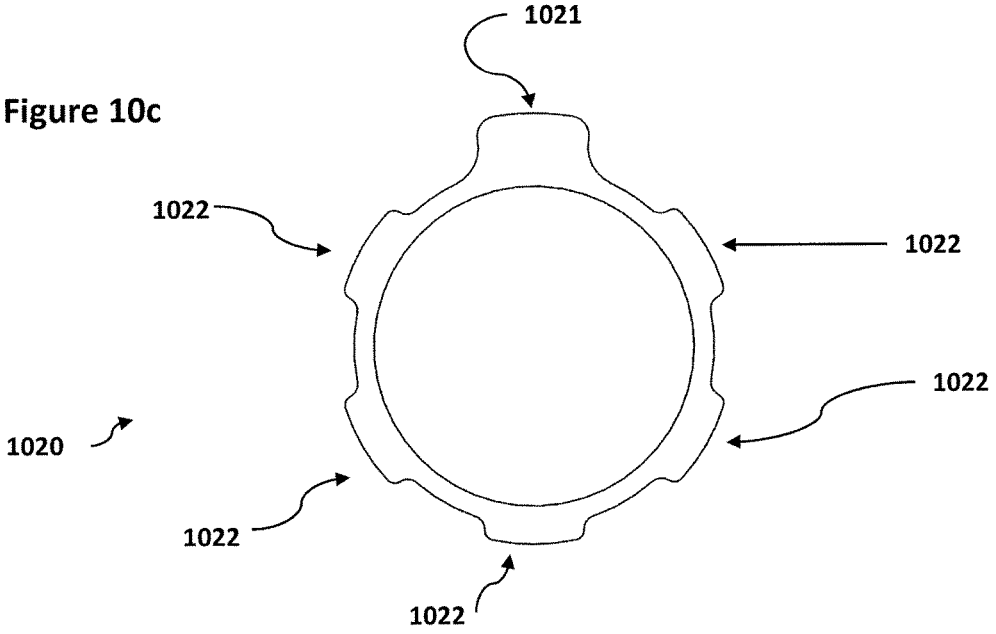
FIG. 10*c* shows a cross section of an additional alternative embodiment of a positioning element of the technology.

FIG. 10*c* shows a cross section of an assembly 1020 of an additional alternative embodiment of a positioning element of the technology. Assembly 1010 includes one primary positioning element structure surface at 1021 and five secondary positioning element structure surfaces at 1022.

As can be seen from FIGS. 10*a*, 10*b*, and 10*c*, the degrees of arc of the outer surfaces of the primary element structure may cover as little as approximately 25 degrees as in 10*c*, or greater amounts of degrees of arc as in 10*a* and 10*b*. In the technology of this application, the maximum degrees of arc of the outer surfaces of the primary element structure does not exceed 175 degrees.

Figure 11:
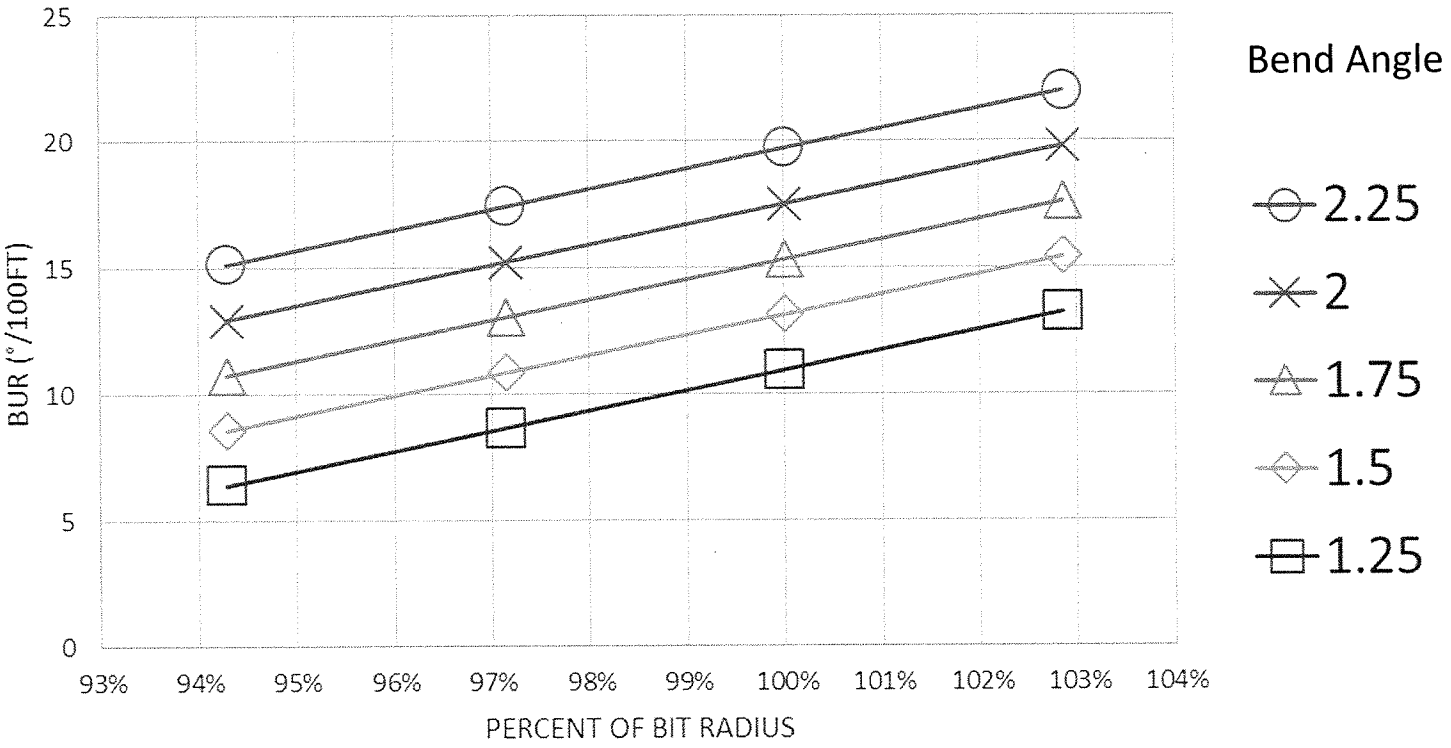
FIG. 11 is a chart of calculated build rates (BUR) for various assembly bend angles of assemblies employing the technology of the present application.

FIG. 11 is a chart of geometrically calculated build rates (BUR) for various assembly bend angles of assemblies employing the technology of the present application. In this example, a series of bend angles ranging from 1.25 degrees to 2.25 degrees are considered on an assembly with an exemplary nominal 8.750 bit diameter. A range of primary outer positioning element structure surfaces radial extensions are represented. These radial extensions range from just over 94% of the nominal bit radius to almost 103% of nominal bit radius. It can be seen that as the radial extension of the outer surfaces increase for a given bend angle, the BUR increases in degrees per 100 feet.

As can be seen from the detailed figures in applying the technology of this application, the designer is free to radius or bevel the edges of the outer surfaces of the positioning element structures. Additionally the designer may choose to bevel, taper or curve the proximal and/or distal ends of the outer surfaces of the positioning element structures to transition or blend them with the tool or sleeve body.

It should be additionally noted that the designer may taper the proximal portion of the primary outer surfaces of a near bit positioning element structure in order to reduce the stresses encountered in the slide to rotate stress condition referred to previously.

In applying the technology of this application, the designer may choose to not employ traditional kick/wear pad at or near the bend of the assembly. It should be understood that the use of traditional kick/wear pad is at the discretion of the designer.

As to manufacturing technique, it is also possible to create a modified bottom hole assembly according to the teachings of this application by selectively grinding or milling some of the outer surfaces of the blades of traditional directional BHA stabilizers to allow them to meet the limits of secondary outer positioning element structures while leaving the remaining blades unground or unmilled, or adding material to the remaining blades such as by welding, so as to cause them or allow them to meet the limits of primary outer positioning element structures. Additionally, flat top or dome top tungsten carbide or PDC inserts can be inserted into sockets formed in the primary outer positioning structure. These inserts can be placed for an exposure above the pad or surface of the positioning element primary structure to allow the structure to meet the limits of the primary outer surfaces of the technology.

Although the technology of the present application has been described with reference to specific embodiments, these descriptions are not meant to be construed in a limiting sense. Various modifications of the disclosed embodiments, as well as alternative embodiments of the technology will become apparent to persons skilled in the art upon reference to the description of the invention. It should be appreciated by those skilled in the art that the conception and the specific embodiments disclosed may be readily utilized as a basis for modifying or designing other structures for carrying out the same purposes of the technology. It should also be realized by those skilled in the art that such equivalent constructions do not depart from the spirit and equivalent constructions as set forth in the appended claims. It is, therefore, contemplated that the claims will cover any such modifications or embodiments that fall within the scope of the technology.

We claim:

1. A downhole directional drilling apparatus configured to attach to a drill string, the apparatus comprising, a drill bit, the drill bit having a cutting structure;

a bent housing positive displacement motor; and a positioning element mounted proximal a bend angle of the drilling apparatus, wherein the positioning element comprises a first fixed blade generally on a scribe side of the drilling apparatus having an outermost surface with a first fixed radius from an axial centerline of the drilling apparatus, the first fixed radius equal to a fixed value that is from 0.91 to 1.05 of a nominal radius of the drill bit, and the positioning element having a surface on the bend side of the drilling apparatus, the surface having a second fixed radius from the axial centerline, the second fixed radius having a fixed value that is less than 0.90 of the nominal radius of the drill bit and greater than a nominal radius of a housing of the drilling apparatus, wherein the first fixed blade is stationary relative to the axial centerline of the drilling apparatus.

2. The apparatus of claim 1 further comprising a kick pad generally adjacent and above the bend angle of the drilling apparatus.

3. The apparatus of claim 1 further comprising a distal positioning element mounted distal the bend angle of the drilling apparatus, wherein the distal positioning element comprises a distal fixed blade generally on the bend side of the drilling apparatus, the distal fixed blade having a distal fixed blade radius from the axial centerline of the drilling apparatus, and the distal positioning element comprising a distal surface generally on the scribe side of the drilling apparatus where the distal surface generally has a distal surface fixed radius that is less than the distal blade radius, wherein the distal fixed blade is stationary relative to the axial centerline of the drilling apparatus.

4. The apparatus of claim 1 wherein the positioning element includes at least one of a tapered transition or curved transition between the first fixed blade surface and the drilling apparatus.

5. The apparatus of claim 3 wherein both the distal positioning element and the positioning element include tapered or curved transitions between the fixed blade surfaces and a tool body of the drilling apparatus.

6. The apparatus of claim 5 wherein an outermost surface of the distal fixed blade generally on the bend side of the distal positioning element comprises the distal fixed radius from the axial centerline of the drilling apparatus equal to a fixed value that is from 0.91 to 1.05 of the nominal radius of the drill bit; and wherein the distal surface fixed radius of the distal surface generally on the scribe side of the distal positioning element comprises a fixed value that is less than 0.90 of the nominal radius of the drill bit.

7. The apparatus of claim 5 wherein the outermost surfaces of the distal fixed blades of the distal positioning element are relieved in a proximal direction.

8. The apparatus of claim 5 wherein the outermost surface of the distal fixed blades of the distal positioning element are tapered in a proximal direction.

9. The apparatus of claim 1, wherein the positioning element is circumferentially asymmetric.

10. The apparatus of claim 9, wherein the positioning element is axially asymmetric.

11. A bent housing configured for attachment to a wellbore downhole assembly comprising:

a bent housing positive displacement motor having a scribe side and a bend side wherein the bent housing comprises a bend angle;

a positioning element mounted on the bent housing positive displacement motor proximal the bend angle, wherein the positioning element comprises a first fixed blade generally on the scribe side that has an outermost surface with a first fixed radius from an axial centerline of the bent housing positive displacement motor, and wherein the positioning element comprises a surface on the bend side that has a second fixed radius from the axial centerline, wherein the second fixed radius is less than the first fixed radius;

a kick pad on the bent housing positive displacement motor, the kick pad positioned adjacent the bend angle; and a distal positioning element mounted distal the bend angle, wherein the distal positioning element comprises a distal fixed blade generally on the bend side, the distal fixed blade having a distal blade fixed radius from the axial centerline, and the distal positioning element having a distal surface generally on the scribe side, wherein the distal surface generally has a distal surface fixed radius that is less than the distal blade fixed radius;

wherein the outermost surface of the first fixed blade generally on the scribe side of the positioning element comprises a fixed radius from the axial centerline of the assembly equal to a fixed value that is from 0.91 to 1.05 of a nominal radius of the drill bit;

wherein the surface on the bend side of the positioning element comprises a fixed radius from the axial centerline of the tool having a fixed value that is less than 0.90 of the nominal radius of the drill bit; and wherein the outermost surface of the distal fixed blade generally on the bend side of the distal positioning element comprises the distal fixed radius from the axial centerline equal to a fixed value that is from 0.91 to 1.05 of the nominal radius of the drill bit wherein the distal surface fixed radius of the distal surface generally on the scribe side of the distal positioning element comprises a fixed value that is less than 0.90 of the nominal radius of the drill bit.

* * * * *